US010134507B2

(12) United States Patent
Wu et al.

(10) Patent No.: US 10,134,507 B2
(45) Date of Patent: Nov. 20, 2018

(54) CABLE HAVING IMPROVED ANTI CROSS TALK PERFORMANCE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/296,264

(22) Filed: Oct. 18, 2016

(65) Prior Publication Data

US 2017/0110221 A1 Apr. 20, 2017

(30) Foreign Application Priority Data

Oct. 20, 2015 (CN) ..... 2015 1 0679010

(51) Int. Cl.

| | |
|---|---|
| ***H01B 11/04*** | (2006.01) |
| ***H01B 11/08*** | (2006.01) |
| ***H01B 11/20*** | (2006.01) |
| *H01B 11/18* | (2006.01) |

(52) U.S. Cl.

CPC ..... *H01B 11/08* (2013.01); *H01B 11/20* (2013.01); *H01B 11/1891* (2013.01)

(58) Field of Classification Search

CPC ..... H01B 11/04
USPC ..... 174/113 R
See application file for complete search history.

(56) References Cited

U.S. PATENT DOCUMENTS

| | | | | |
|---|---|---|---|---|
| 5,956,445 | A * | 9/1999 | Deitz, Sr. | G02B 6/441 174/24 |
| 9,244,240 | B2 | 1/2016 | Sumitomo | |
| 2004/0040736 | A1* | 3/2004 | Nishimura | H01B 11/02 174/113 R |
| 2010/0051318 | A1* | 3/2010 | Wang | H01B 11/12 174/113 R |
| 2010/0258333 | A1 | 10/2010 | Horan et al. | |
| 2012/0103651 | A1 | 5/2012 | Kim | |
| 2014/0238722 | A1* | 8/2014 | Hayashishita | H01B 13/34 174/115 |
| 2016/0079689 | A1 | 3/2016 | Wu et al. | |
| 2016/0079714 | A1 | 3/2016 | Wu et al. | |

OTHER PUBLICATIONS

Universal Serial Bus Type-C Cable and Connector Specification Revision 1.0 Aug. 11, 2014.

* cited by examiner

*Primary Examiner* — Chau N Nguyen
(74) *Attorney, Agent, or Firm* — Wei Te Chung; Ming Chieh Chang

(57) ABSTRACT

A cable (100) includes a plurality of wires (10) and a jacket (20) enclosing the wires. The wires includes a plurality of differential signal wires (11) for transmitting high speed signal, a detection signal wire (12), at least one auxiliary signal wire (13), and a plurality of lower speed signal wires (14). All of the differential signal wires, the detection signal wire and the at least one auxiliary signal wire are arranged at an outer peripheral of and enclosing the lower signal wires. Each two adjacent differential signal wire pairs are separated by one of the detection signal wire and the at least one auxiliary signal wire.

1 Claim, 2 Drawing Sheets

CABLE HAVING IMPROVED ANTI CROSS TALK PERFORMANCE

BACKGROUND OF THE INVENTION

1. Field of the Invention

The present invention relates to a cable, and more particularly to an wires arrangement of the cable.

2. Description of Related Arts

USB Type-C Cable and Connector Specification Revision 1.0 published on Aug. 11, 2014, illustrates a high speed cable comprising a plurality of first wires (for USB 2.0 signaling, SBU1, SBU2, CC, power return, and Vconn), an inner shielding layer enclosing the first wires, a plurality of coaxial wires (differential pairs) for high speed signaling arranged at an outer side of the inner shielding, and a power wire disposed between the coaxial wires.

U.S. Patent Application Publication No. 2016/0079714, published on Mar. 17, 2016 to Wu et al., discloses a cable comprising a plurality of coaxial wires having a similar structure as the high speed cable of the USB Type-C Cable Specification Revision 1.0. Low frequency cross talk between the first wires for SBU1, SBU2 and first wire for CC, and between the first wires for SBU1, SBU2 and the first wire for USB 2.0 is too high.

Hence, an improved cable is desired to offer advantages over the related art.

SUMMARY OF THE INVENTION

An object of the present invention is to provide a cable having a lower low frequency cross talk.

To achieve the above-mentioned object, a cable comprises a plurality of wires, the wires comprises a plurality of differential signal wires for transmitting high speed signal, a detection signal wire, at least one auxiliary signal wire, and a plurality of lower speed signal wires, all of the differential signal wires, the detection signal wire and the at least one auxiliary signal wire arranged at an outer peripheral of and enclosing the lower signal wires, each two adjacent differential signal wire pairs separated by one of the detection signal wire and the at least one auxiliary signal wire; and a jacket enclosing the wires.

According to the present invention, the detection signal wire and the at least one auxiliary signal wire are arranged at an outer side and between adjacent two differential signal wire pairs, respectively that will increase a distance between the detection signal wire and the at least one auxiliary signal wire, and be shielded by differential signal wire pairs. Therefore, a low frequency cross talk between the detection signal wire and the at least one auxiliary signal wire is decreased.

DETAILED DESCRIPTION OF THE PREFERRED EMBODIMENT

Reference will now be made in detail to a preferred embodiment of the present invention.

Figure 1:
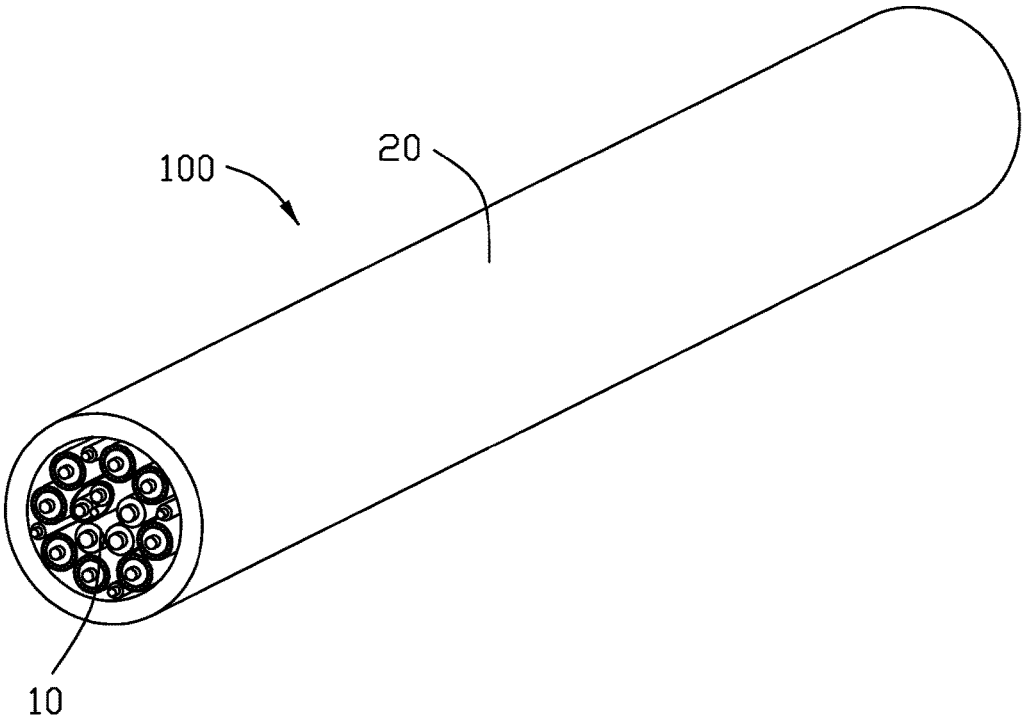
FIG. 1 is a perspective view of a USB Type C cable in accordance with present invention.
Figure 2:
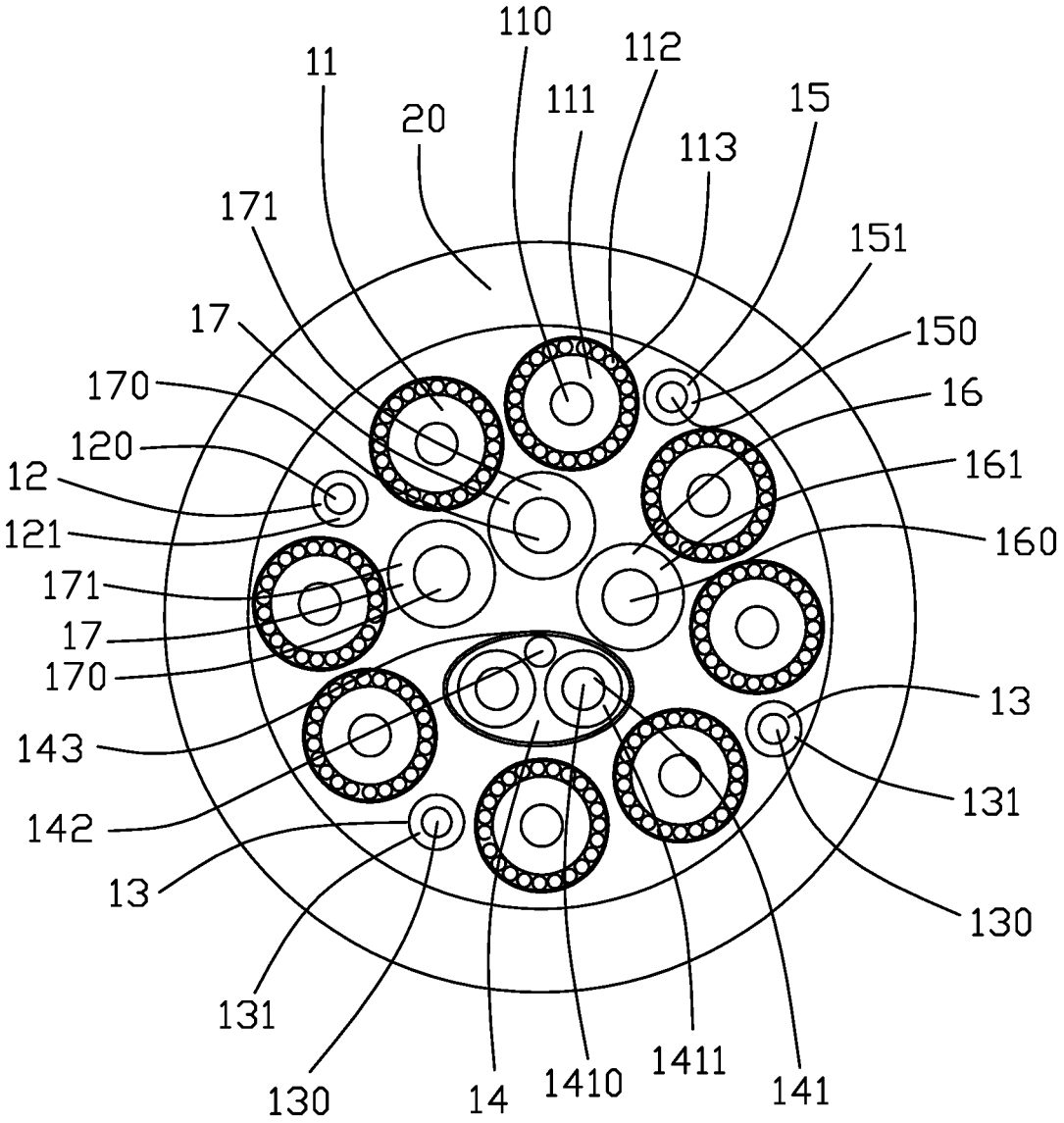
FIG. 2 is cross section view of the USB Type C cable as shown in FIG. 1.

Referring to FIGS. 1 to 2, a cable 100 comprises a plurality of wires 10, a jacket 20 enclosing the wires 10, and a shielding layer (not shown) disposed between the wires 10 and the jacket 20. The cable 100 is used for transmitting signal in accordance with USB C standard.

The wires 10 comprises a plurality of differential signal wires 11 for transmitting high speed signal, a detection signal wire 12 for transmitting detection signal, a pair of auxiliary signal wires 13 for transmitting detection signal, and a plurality of lower speed signal wires 14 for transmitting USB 2.0 signal, a power wire 15, a positive power wire 16 for transmitting a positive power signal, and a pair of negative power wires 17 for transmitting a common negative power signal.

All of the differential signal wires 11, the detection signal wire 12, and the auxiliary signal wires 13 are arranged at an outer peripheral of and commonly to enclose the lower signal wires 14. Each two adjacent differential signal wire pairs 11 are separated by one of the detection signal wire 12 and the auxiliary signal wires 13. In other word, a pair of differential signal wires is arranged between the detection signal wire 12 and each one of the auxiliary signal wires 13, or between the pair of the signal wires 13. Distances between the detection signal wire 12 and each one of the auxiliary signal wires 13 are increased that will decrease a low frequency cross talk and coupling effect between the detection signal wire 12 and each one of the auxiliary signal wires 13.

All of the differential signal wires 11 are coaxial wires. Each of the differential signal wires 11 comprises a central conductor 110, a inner insulative layer 111 enclosing the central conductor 110, a shielding layer 112 enclosing the inner insulative layer 111, and an outer insulative layer 113 enclosing the shielding layer 112. The shielding layers 112 of each differential signal wire pairs could further decrease the low frequency cross talk and coupling effect between the detection signal wire 12 and each one of the auxiliary signal wires 13.

In this embodiment, the number of the differential signal wires 11 is four pairs that can be for four differential signal to transmit. The auxiliary signal wires 13 may be used to transmit audio signal or other signal.

The detection signal wire 12 comprises an inner conductor 120 and an outer insulative layer 121 enclosing the inner conductor 120. Each of the auxiliary signal wires 13 comprises an inner conductor 130 and an outer insulative layer 131 enclosing the inner conductor 130. Each of the differential signal wires 11 has an outer diameter larger than a diameter of the detection signal wire 12 and the auxiliary signal wires 13. In this embodiment, a specification for each of the central conductor 110 of the differential signal wires 11 is 32 AWG (American wire gauge). A specification for each of the inner conductor 120, 130 of the detection signal wire 12 and the auxiliary signal wires 13 is 34 AWG.

The power wire 15 is arranged at the outer peripheral of the lower signal wires 14 and between two pair of the differential signal wires 11. The power wire 15 is used to transmit power to an inner IC of a connector (not shown) connected with the cable 100. At least one pair of differential signal wires 11 is arranged between the power wire 15 and the detection signal wire 12, or between the power wire 15 and each one of the auxiliary signal wires 13. The power wire 15 comprises an inner conductor 150 and an outer insulative layer 151 enclosing the inner conductor 150. Each of the outer diameters of the differential signal wires 11 is larger than a diameter of the power wire 15. In this embodiment, a specification for the inner conductor 150 of the power wire 15 is 34 AWG.

The lower speed signal wires 14 comprises a twisted pair 141 for being used to transmitting USB 2.0 signal, a grounding wire 142, and a inner shielding layer 143 enclosing the twisted pair 141 and the grounding wire 142. The grounding wire 142 is a bare wire and directly electrically connected with the shielding layer 143. The twisted pair 141 comprises a pair of inner conductors 1410 and inner insulative layers enclosing the inner conductors 1410, respectively. A specification for each of the inner conductors 1410 of the twisted pair 141 is 32 AWG or 34 AWG. As the detection signal wire 12 and the auxiliary signal wires 13 are arranged at the outer side peripheral of the lower signal wires 14 and separated by the differential signal wires 11, distances between the detection signal wire 12 and the lower signal wires 14, or between the lower signal wires 14 and each one of the auxiliary signal wires 13 are increased that will decrease cross talk between the detection signal wire 12 and the lower signal wires 14, or between the lower signal wires 14 and each one of the auxiliary signal wires 13. The shielding layer 143 is made from aluminum foil that can drain noise ground to improve anti EMI performance of the lower signal wires 14.

The positive power wire 16 and the negative power wires 17 are arranged adjacent to the lower signal wires 14 and enclosed by the differential signal wires 11, the detection signal wire 12, the auxiliary signal wires 13, and the power wire 15. The positive power wire 16 comprises an inner conductor 160 and an outer insulative layer 161 enclosing the inner conductor 160. Each of the negative power wires 17 comprises an inner conductor 170 and an outer insulative layer 171 enclosing the inner conductor 170. Each of the outer diameters of the differential signal wires 11 is larger than a diameter of each of the positive power wire 16 and the negative power wires 17. A specification for each of the inner conductors 160, 170 of the positive power wire 16 and the negative power wires 17 is 26 AWG. Each of the inner conductors 160, 170 of the positive power wire 16 and the negative power wires 17 having an outer diameter is larger than an outer diameter each of the central conductors 110 of the differential signal wires 11. Notably, in this embodiment, the four pairs of differential signal wires 11 and the corresponding detention signal wire 12, a pair of auxiliary signal wires 13 and power wire 15 are alternately arranged with each other in the outer (ring) zone while the pair of low speed signal wires 14 the positive power wire and the pair of negative power wires 17 are arranged in the inner zone wherein the detention signal wire 12, the pair of auxiliary signal wires 13 and the power wire 15 are spaced from one another at 90 degrees and the corresponding four pairs of the differential signal wires 11 are respectively locate in the different four quadrants while each pair is compliantly arranged along the corresponding periphery of the outer ring zone. Under this arrangement, the internal wires of the whole cable are essentially densely symmetrically disposed/dispersed in the jacket 20, thus being easy to make.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable comprising:

an insulative jacket enclosing therein a plurality of wires arranged in an inner zone and an outer ring zone, said wires including:

four pairs of differential signal wires alternately arranged with a detection wire, a pair of auxiliary signal wires and a power wire in the outer ring zone wherein said detention wire, said pair of auxiliary signal wires and said power wire are located at positions with 90-degree intervals and the four pair of differential signal wires are locate in corresponding different four quadrants, respectively, each pair of differential signal wires being arranged along a periphery of said outer ring zone;

a pair of signal wires cooperating with a grounding wire commonly enclosed within a shielding layer and located in the inner zone; and a pair of negative power wires and a positive power wire commonly located in the inner zone; wherein each differential signal wire is diametrically larger than each of the pair of negative power wires and the positive power wire, and each of the pair of negative power wires and the positive power wire is diametrically larger than each of the power wire, the detection signal wire, and the auxiliary signal wire.

* * * * *